United States Patent [19]

Dick, Jr.

[11] 4,165,199

[45] Aug. 21, 1979

[54] PROCESS AND APPARATUS FOR APPLYING AND COMPACTING CASTABLE MATERIAL IN STRIPS ON A SLOPED SURFACE

[75] Inventor: Perry J. Dick, Jr., Pittsburgh, Pa.

[73] Assignee: Trumbull Corporation, Pittsburgh, Pa.

[21] Appl. No.: 907,560

[22] Filed: May 19, 1978

Related U.S. Application Data

[62] Division of Ser. No. 784,073, Apr. 4, 1977.

[51] Int. Cl.[2] ..... E01C 19/26; E02D 3/02

[52] U.S. Cl. ..... 405/271; 404/124; 404/127

[58] Field of Search ..... 61/63; 404/127, 124, 404/96, 98, 103, 104, 105, 102, 101

[56] References Cited

U.S. PATENT DOCUMENTS

| | | | |
|---|---|---|---|
| 690,893 | 1/1902 | McGuire | 404/127 X |
| 827,587 | 7/1906 | Warner | 404/124 X |
| 1,043,239 | 11/1912 | Lee | 404/124 |
| 1,981,788 | 11/1934 | Gardner | 404/127 X |
| 3,233,530 | 2/1966 | Brebner | 404/124 |
| 3,383,992 | 5/1968 | Kaltenegger | 404/127 |
| 3,868,194 | 2/1975 | Ferguson et al. | 404/126 |

*Primary Examiner*—Dennis L. Taylor

*Attorney, Agent, or Firm*—Stanley J. Price, Jr.; John M. Adams

[57] ABSTRACT

An earthen structure for holding back a body of water has a sloped surface which is paved with an overlapping arrangement of strips constructed of castable material. Each strip is formed by conveying castable material from a mobile receiving hopper that is propelled adjacent to the base of the earthen structure. A bridge conveyor projects laterally from the receiving hopper over the slope. The bridge conveyor deposits the castable material onto the slope forwardly of a spreader device that is advanced longitudinally relative to the slope by a prime mover. A scraper blade of the spreader device is positioned at a preselected elevation by a forwardly projecting sidewall which is connected to the blade and slidable on a previously formed strip. The sidewall maintains the castable material in front of the blade, as the advancing blade spreads the material in a longitudinal strip of a preselected thickness and having a lateral edge extending a preselected lateral dimension outwardly from the sloped surface. The formed strip is compacted by a pair of vibrating rollers propelled in tandem relation behind the spreader device. The rollers have forming end portions that engage the lateral edge of the strip to round and compact the edge.

5 Claims, 8 Drawing Figures

PROCESS AND APPARATUS FOR APPLYING AND COMPACTING CASTABLE MATERIAL IN STRIPS ON A SLOPED SURFACE

CROSS REFERENCE TO RELATED APPLICATIONS

This application is a division of copending application, Ser. No. 784,073 filed on Apr. 4, 1977, entitled "Process And Apparatus For Applying And Compacting Castable Material In Strips On A Sloped Surface".

BACKGROUND OF THE INVENTION

1. Field of the Invention

This invention relates to a process and apparatus for applying and compacting castable material in a step-like arrangement of strips on a sloped surface and more particularly to a process and apparatus for paving the sloped surface with strips having a preselected thickness and lateral dimension with a preselected degree of compaction.

2. Description of the Prior Art

Earthen structures for holding back or containing a body of water as for example in the instance of canals, dikes, coastal breakers, cooling ponds, diversion islands and the like are subject to erosion by the generation of waves within the body of water. The earthen structure generally consists of sloping walls having a smooth surface which presents little or no resistance to waves. Consequently, under high wind conditions the wave problem can increase to the point where water is directed over the top of the earthen structure and directed upon the foundation thereof. If this condition is allowed to continue eventual erosion of the foundation will occur, weakening the earthen structure until it is no longer capable of holding back the body of water. The erosion problem is magnified by the fact that the smooth sloped surface of the earthen structure presents little or no resistance to the waves. Therefore, in order to prevent erosion of the earthen structure it is known to break up the wave action generated within the body of water by constructing a step-like surface on the slope of the earthen structure . U.S. Pat. No. 3,966,343 discloses a paving machine that covers a sloping surface of the earthen structure of a cooling pond with a series of step-like strips that extend longitudinally upon the sloped surface. The strips are cast in a continuous process and are constructed of a castable material that includes an admixture of soil and cement. It is also known to employ other methods of constructing strips or breakers on a sloped surface that require the use of forms which must be constructed before the castable material is poured. It has also been suggested to erect step-like breakers by laying precast breakers in strips upon the sloped surface. However, these methods require a considerable expenditure of effort and time in their construction.

While it has been suggested to construct breakers on a sloped surface by a continuous casting process that eliminates the use of forms, there is need for an apparatus for continuously casting strips in which each strip has a preselected thickness and extends at a preselected lateral dimension outwardly from the sloped surface. Furthermore, it is critical in a continuous casting process that the strips be compacted to a preselected degree of compaction in order to resist the forces of erosion.

SUMMARY OF THE INVENTION

In accordance with the present invention there is provided apparatus for applying and compacting castable material on a sloped surface that includes a device for depositing the castable material on the sloped surface. A spreader device applies the castable material in a strip of a preselected thickness extending longitudinally on the sloped surface and having a lateral edge extending a preselected lateral dimension outwardly from the sloped surface. A roller assembly positioned rearwardly of the spreader device compacts the strip to a preselected degree of compaction. A forming apparatus is associated with the roller assembly and is operable to round the lateral edge of the strip in an arcuate configuration. A propelling mechanism advances the spreader device and the roller assembly on the sloped surface.

The spreader device includes a sidewall that projects forwardly of the spreader device and is operable to maintain the castable material forwardly thereof. Preferably, the spreader device has a scraper blade positioned forwardly of the propelling mechanism that includes a first prime mover, such as a bulldozer. The scraper blade is connected to the frame of the bulldozer by an articulated mechanism that permits the lower edge of the scraper blade to be moved to a preselected angular position relative to the sloped surface.

The sidewall is secured to the scraper blade and has a lower edge that extends below the lower edge of the scraper blade. With this arrangement the lower edge of the sidewall is slidable on a previously formed strip and is positioned a preselected distance from the outer lateral edge of the previously formed strip. The sidewall is connected to the scraper blade at a preselected location along the length thereof. This arrangement serves to guide the lower edge of the scraper blade at a preselected elevation above the previously formed strip for forming another strip in overlapping relation therewith of a thickness corresponding to the thickness of the previously formed strip.

By maintaining the sidewall spaced a preselected lateral distance from the edge of the previously formed strip a series of strips are formed in which the strips overlap with their edge portions offset to form a step-like configuration on the sloped surface. The step-like configuration serves to break up the wave action generated within a body of water confined by the sloped surface to prevent erosion of the sloped surface.

The spreading operation is followed by a compacting operation accomplished by the roller assembly that includes a pair of rollers that are propelled by prime movers, such as tractors, over the strip formed by the spreader device. A first roller is pushed by the tractor behind the bulldozer that forwardly propels the spreader device. The roller compacts the strip to a preselected degree of compaction and is followed by a second roller. The second roller is pulled by a tractor to complete the compaction operation, where the first roller is pushed and the second roller is pulled over the formed strip.

The forming apparatus associated with each of the rollers is arranged to engage the lateral edge of the formed strip. The forming apparatus has a frustoconical portion having the configuration of a frustum of a cone with the curved portion of the cone arranged to contact the outer lateral edge. The curved portion terminates in a lip portion that extends opposite the lateral edge and downwardly the depth of the strip. As each roller traverses the strip a rounded edge is formed and compacted. In addition, a vibrating device is eccentrically positioned within the interior portion of each roller. The vibrating device is operable to impart a vibrating force to the roller. This serves to increase the degree of compaction obtained by rolling the formed strip.

Accordingly, the principal object of the present invention is to provide apparatus for applying and compacting castable material in overlapping strips to form breakers on a sloped surface which is operable to hold back a body of water where the strips have a preselected degree of compaction to resist erosion.

Another object of the present invention is to provide a spreader device for applying the castable material in a strip of a preselected thickness extending longitudinally on the sloped surface and having a lateral edge extending a preselected lateral dimension outwardly from the sloped surface.

A further object of the present invention is to provide compaction apparatus for compacting a strip formed on the sloped surface to a preselected degree of compaction and forming a rounded, compacted edge on the strip.

An additional object of the present invention is to provide a continuous process for paving a sloped surface surrounding a body of water with an overlapping arrangement of strips extending longitudinally on the sloped surface and having a preselected degree of compaction to resist erosion by wave action.

These and other objects of the present invention will be more completely disclosed and described by the following specification, the accompanying drawings and the appended claims.

DESCRIPTION OF THE PREFERRED EMBODIMENT

Figure 1:
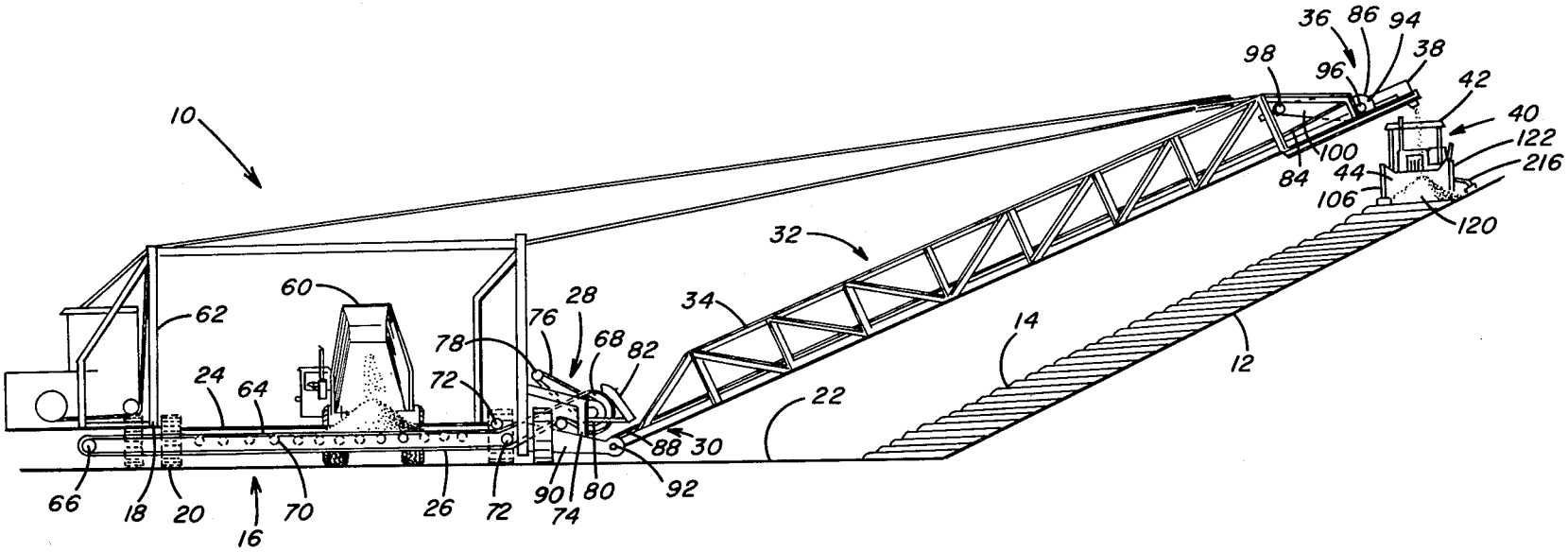
FIG. 1 is a view in side elevation of a paving apparatus illustrating a mobile material receiver connected to a bridge conveyor for depositing castable material onto an inclined slope to be paved in overlapping strips by a spreading device that traverses the slope.
Figure 2:
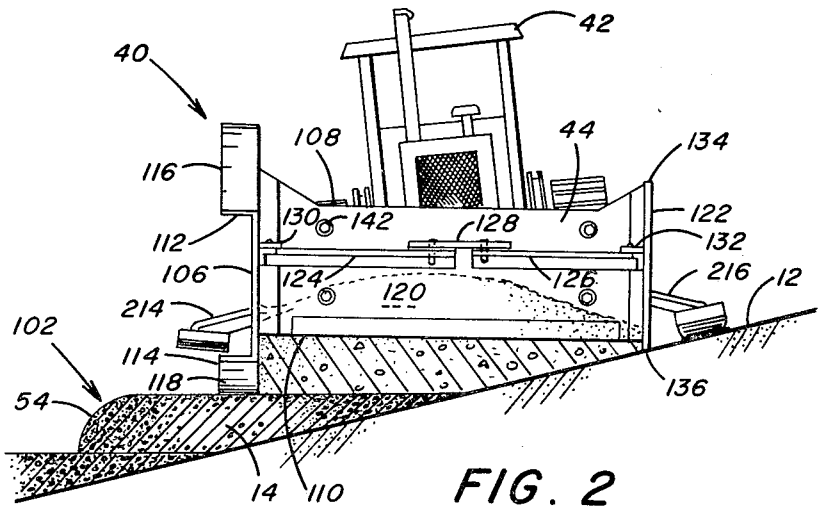
FIG. 2 is a front view of the spreader device shown in FIG. 1, illustrating a scraper blade maintained at a preselected elevation by a forwardly extending sidewall to form a strip extending outwardly from the slope and having a preselected thickness.
Figure 3:
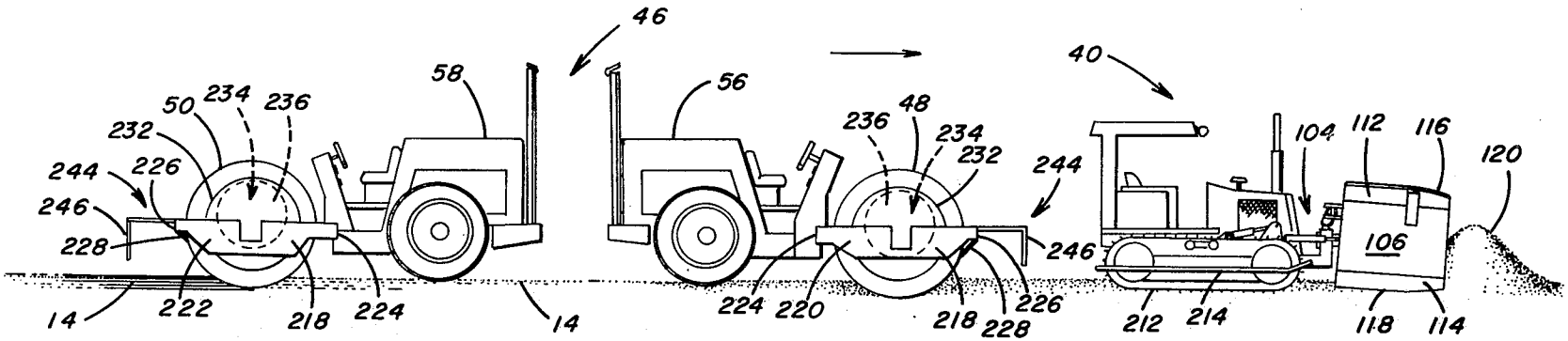
FIG. 3 is a view in side elevation of the spreader device followed by a tandem arrangement of vibrating rollers, illustrating a first roller pushed by a prime mover behind the spreader device and a second roller pulled by a prime mover behind the first roller on the strip.

Referring to the drawings, and particularly to FIGS. 1-3, there is illustrated apparatus 10 for applying and compacting castable material on a sloped surface 12 that forms the perimeter of a power plant cooling pond, a canal, a dike or any other sloped surface for holding back a body of water. The apparatus 10 is operable in accordance with the present invention to install a plurality of parallel overlapping breakers 14, or strips, in a step-like arrangement on the sloped surface 12. The sloped surface 12 is constructed primarily of earthen material and the breakers 14 constructed of a castable material, such as a mixture of soil and cement serve to prevent erosion of the wall 12 by breaking up wave action generated in the body of water contained by the sloped wall 12. By breaking up the wave action water is prevented from flowing over the upper edge of the wall and eroding the earthen structure surrounding the body of water.

The apparatus 10 includes a material receiver generally designated by the numeral 16 that includes a frame portion 18 mounted on a suitable propelling device, such as endless tracks 20. The endless tracks 20 are forwardly propelled on the floor 22 of the pond or canal to be constructed by a suitable prime mover that is supported by the frame portion 18 and drivingly connected to the endless tracks 20. In this manner the material receiver 16 is forwardly propelled in a direction parallel to the sloped wall 12.

The material receiver 16 includes a receiving hopper 24 having a conveyor 26 extending the width of the hopper 24. A discharge end portion 28 of the conveyor 26 is positioned in overlying relation with a receiving end portion 30 of a bridge conveyor generally designated by the numeral 32 that is positioned on a conveyor support frame 34. The conveyor support frame 34 is connected to the frame 18 of the receiving hopper 24 for vertical pivotal movement and is also movable with the receiving hopper 24. The bridge conveyor 32 extends above the sloped surface 12 and includes at its upper end portion an end portion 36 that is selectively positioned for depositing the castable material on the sloped surface. A feed hopper 38 is positioned at the end portion 36 and directs the castable material downwardly onto the sloped surface in advance of a spreader device generally designated by the numeral 40.

The spreader device 40 includes a prime mover, such as a bulldozer 42, and an articulated scraper blade 44 mounted to the front end of the bulldozer 42. The castable material is deposited from the bridge conveyor 32 forwardly of the advancing scraper blade 44 onto the sloped surface 12. The bridge conveyor 32 is forwardly propelled in advance of the bulldozer 42 by the track-propelled material receiver 16. The scraper blade 44, in a manner to be explained hereinafter in greater detail, applies the castable material in a strip upon the sloped surface 12 with the paving operation begining on the sloped surface 12 adjacent the floor 22 and progressively advancing up the slope as the spreader device 40 moves longitudinally, back and forth, on the sloped surface to apply the strips 14 in a step-like arrangement on the sloped surface.

Figure 4:
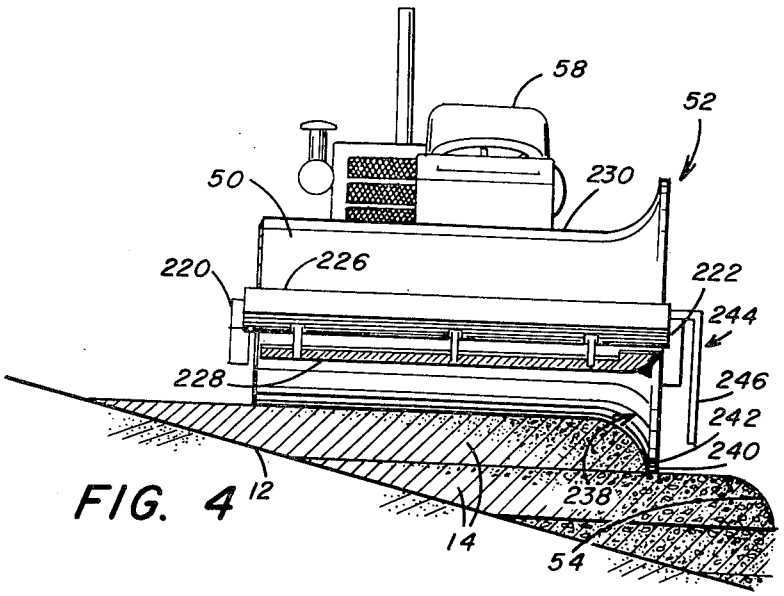
FIG. 4 is a rear view of the pulled roller illustrated in FIG. 1 showing an edge portion of the roller having a frustoconical configuration for forming and compacting the outer longitudinal edge of the strip formed by the spreader device.

A compaction device generally designated by the numeral 46 in FIG. 3 follows the spreader device 40 and is operable to compact the strip of castable material laid down by the scraper blade 44 to provide the strip with a preselected degree of compaction. The compaction device 46 preferably includes a pair of rollers 48 and 50 positioned in tandem and having a cylindrical configuration with a forming end portion 52 having the configuration of a frustum of a cone that serves to round the exposed or lateral edge of the strip 14 being formed. This configuration is illustrated in FIG. 4 and forms a curved edge or curb 54 on the strip 14. The rollers 48 and 50 are propelled by suitable propelling means, such as prime movers 56 and 58 which are illustrated in FIG. 3 as wheel mounted tractors.

The roller 48 is positioned forwardly of the tractor 56 so that the tractor 56 pushes the roller 48 behind the bulldozer 42 to compact the strip formed by the scraper blade 44. The roller 48 also forms the curved edge 54 on the strip 14. The tractor 58 follows tractor 56 on the strip being formed and forwardly advances the roller 50 by pulling the roller 50, which trails behind the tractor 58. With this arrangement the strip 14 is constructed by the scraper blade 44 and compacted with a curved edge 54 formed and compacted on the exposed lateral edge of the strip by the rollers 48 and 50. The sequential operation of pushing a first roller behind the bulldozer 42 followed by pulling a second roller behind the first roller compresses the formed strip to a preselected degree of compaction to resist wear by erosion.

The paving material for forming the series of step-like breakers 14 on the sloped wall 12 of the pond is a castable material such as concrete or, more preferably, an admixture of cement and soil. The castable material is deposited into the receiving hopper 24 of the material receiver 16 by a dump truck 60 that advances forwardly in material receiving relation with the hopper 24. As the material receiver 16 is propelled on the floor of the pond 22 and the scraper and compaction devices 40 and 46 are propelled on sloped wall 12, the dump truck 60 advances at the rate of the material receiver 16 to remain in material receiving relation with the hopper 24. This permits continuous deposition of material into the hopper 24, as well as continuous conveying of the material to the sloped surface 12 to carry out a continuous strip paving operation.

As illustrated in FIG. 1, the material receiver frame portion 18 has an opening 62 adjacent to which the dump truck 60 is positioned as the castable material is discharged from the dump truck onto the transverse conveyor 26. The transverse conveyor 26 extends at least the length of the opening 62 and includes an endless flexible belt 64. The belt 64 is reeved at one end portion around a pulley 66 that is rotatably mounted on the frame portion 18 outside of the opening 62. The opposite end portion or discharge end portion 28 of the belt 64 is reeved around a pulley 68 that is also rotatably mounted to the frame position 18. The upper and lower reaches of the conveyor belt 64 are supported by idler rollers 70. Tension rollers 72 are also mounted on the frame portion 18 in abutting relation with the upper and lower reaches of the conveyor belt 64 to exert a preselected tension thereon. The pulley 68 is rotatably mounted on a brace member 74 that extends outwardly from the frame portion 18.

The conveyor belt 64, as illustrated in FIG. 1, is rotated in a clockwise direction around the pulley 68. The pulley 68 is driven by an endless chain 76 that passes around a drive sprocket 78 at one end and at the opposite end around a sprocket 80 that is coaxially mounted to the pulley 68 on the brace member 74. The endless chain 76 is driven by a hydraulic motor that is mounted on the frame portion 18 of the material receiver 16. A deflector 82 is secured to the brace member 74 in overlying relation with the conveyor belt 64 above the pulley 68. Thus, material deposited onto the upper reach of the conveyor belt 64 from the dump truck 60 is transported by the conveyor belt 64 to the discharge end portion 28 thereof. The material is directed by the deflector 82 as it is discharged from the end portion 28 onto the receiving end portion 30 of the bridge conveyor 32.

As illustrated in FIG. 1, the bridge conveyor 32 includes an endless conveyor belt 84 that is supported intermediate its end portions by the conveyor support frame 34. In another embodiment, not illustrated, the bridge conveyor 32 may also include a series of paddles secured to endless chains that advance the paddles over a floor of the conveyor support frame 34 from the receiving end portion 30 to the end portion 36 of the conveyor 32 to convey the castable material to the sloped surface 12.

The belt conveyor 84 includes the receiving end portion 30 and a discharge end portion 86. The receiving end portion 30 is rotatably supported on the support frame 34 by a pulley 88 that is also rotatably mounted on the frame 34. The discharge end portion 28 of the conveyor belt 64 is positioned in overlying relation with the receiving end portion 30 of the conveyor belt 84. A pair of arm members 90 extends outwardly from the frame portion 18 on opposite sides in underlying relation with the conveyor discharge end portion 28. The lower end of the conveyor support frame 34 and the receiving end portion 30 of conveyor belt 84 are connected about a horizontal pivot 92 to the arm members 90. Suitable hydraulic means connects the conveyor support frame 34 to the arm members 90 to facilitate pivotal movement.

The opposite end of the conveyor belt 84 is rotatably supported by a pulley 94 that is rotatably supported adjacent the feed hopper 38. The pulley 94 is secured for rotation with a sprocket 96. Sprocket 96 is drivingly connected to a sprocket 98 by a chain 100. The sprocket 98 is driven by a suitable hydraulic motor similar to the motor that drives sprocket 80 for rotating the conveyor belt 64. With this arrangement, upon actuation of the hydraulic motor associated with the sprocket 98, the bridge conveyor belt 84 is rotated in a clockwise direction to transport the castable material from the receiving hopper 24 to the feed hopper 38 and therefrom onto the sloped surface 12.

As the castable material is deposited onto the sloped surface 12, the receiving hopper 24 advances in a direction parallel to the sloped surface and thereby preferably maintains the bridge conveyor 32 in a position perpendicular to the direction of travel of the receiving hopper 24. The receiving hopper 24 advances the bridge conveyor 32 forwardly of the spreader device 40. In this manner castable material is continuously deposited in advance of the scraper blade 44 as the bulldozer 42 moves longitudinally on the sloped surface 12. Thus, a continuous paving operation is carried out by the simultaneous feeding of the castable material onto the sloped surface 12 and the casting of the material in strips that are arranged in overlapping relation, as illustrated in FIG. 1. The strips are laid one upon the other in a step-like arrangement progressing from the floor 22 to the top of the sloped surface 12.

As illustrated in FIG. 2, the castable material is deposited in front of the advancing scraper blade 44 onto the surface of a previously formed breaker 14. The material is deposited at a location spaced from the curved edge 54 that is formed by the rollers 48 and 50. A portion of the previously formed breaker 14 remains exposed, and thus the step-like arrangement is constructed. To construct the strips or the breakers 14 in a step-like configuration, the bulldozer 42 positions the scraper blade 44 on a prior formed breaker 14 with one lateral edge of the blade 44 positioned on the sloped surface 12 and the opposite lateral edge spaced a preselected distance from the previously formed curved edge 54.

The spreader device 40 is initially operable to apply the castable material in a strip of a preselected thickness extending longitudinally on the sloped surface 12 and having a lateral edge generally designated by the numeral 102 in FIG. 2 that extends a preselected lateral dimension outwardly from the sloped surface 12. Preferably, the spreader device 40 forms the strip 14 to extend outwardly at a right angle to the sloped surface. The strip 14 is formed by the scraper blade 44 which is connected to the bulldozer 42 by an articulated mechanism generally designated by the numeral 104 in FIGS. 5 and 6. As will be explained later in greater detail the articulated mechanism 104 adjusts the position of the scraper blade 44 relative to the sloped surface 12.

A first sidewall 106 projects forwardly of the scraper blade 44 and is operable to maintain the castable material forwardly thereof. As discussed hereinabove the bridge conveyor 32 is moved by the material receiver 16 forwardly of the spreader device 40 adancing in a preselected longitudinal direction on the sloped surface 12. In this manner the castable material is continuously deposited onto the sloped surface 12 forwardly of the scraper blade 44. The sidewall 106 serves to further confine the castable material between the outer lateral dimension of the scraper blade 44 and the sloped surface 12. Thus, a strip 14 of a preselected configuration and thickness is formed on the sloped surface 12 to extend a preselected lateral dimension outwardly therefrom.

The scraper blade 44, as illustrated in FIG. 2, has an upper edge 108 positioned parallel to a lower edge 110. The sidewall 106 includes a first depending portion 112 and a second depending portion 114. Each of the depending portions incudes skids 116 and 118. The skids 116 and 118 are operable to slidably support the sidewall 106 on the upper surface of a previously formed strip or breaker 14 as a subsequent strip is being cast in overlapping relation therewith. As will be later explained in greater detail, the skid 116 supports the sidewall 106 when the bulldozer 42 is advancing in a first direction along the sloped surface 12, for example, in a direction from north to south; while the skid 118 is operable to support the sidewall 106 on the previously formed strip when the bulldozer 42 advances in the opposite longitudinal direction on the sloped surface 12, for example, in a direction from south to north.

As illustrated in FIG. 2, the skid 118 is shown in position for slidable movement on the previously formed strip 14 and serves as the lower edge of the sidewall 106. The sidewall 106 projects forwardly of the scraper blade 44 with the rearward portion of the sidewall connected to the lateral edge of the scrapper blade 44. The scraper blade 44 is connected to the sidewall 106 so that the skid 118 extends below the lower edge 110 of the scraper blade 44. This arrangement provides a preselected vertical clearance between the scraper blade lower edge 110 and the upper surface of the previously formed strip 14.

In operation the scraper blade 44 is advanced into the pile of castable material 120 deposited onto the strip 14 from the bridge conveyor 32. The forwardly advancing scraper blade 44 directs the castable material from the pile 120 onto the previously formed strip 14. The scraper blade 44 spreads the castable material upon the previously formed strip 14, and, with the lower edge 110 maintained at a preselected elevation thereabove, a subsequent strip is formed having a thickness corresponding to the vertical dimension between the lower edge 110 and the bottom of the skid 118 on the previously formed strip.

The configuration of the formed strip conforms to the lower edge 110 and the depending portion 114 of the sidewall 106 that extends below the lower edge 110. As the scraper blade 44 spreads the castable material upon the previously formed strip, the material is maintained forwardly of the blade 44. In addition, the extension of the strip outwardly from the sloped surface 12 is limited by the position of the sidewall 106 relative to the curved edge 54 of the previously formed strip. This ensures an overlapping arrangement where the previously formed strip extends preferably one foot from the lateral edge 102 of the strip being formed where the total lateral dimension of the strip from the sloped surface 12 is about six feet.

The sidewall 106 is connected to the scraper blade 44 at a preselected location along the length of the scraper blade so as to provide a strip having a preselected lateral dimension extending outwardly from the sloped surface 12. In addition, the sidewall 106 is arranged to guide the lower edge 110 of the blade 44 at a preselected elevation above the previously formed strip. In this manner, for each pass of the bulldozer 42 longitudinally on the sloped surface 12, overlapping strips are formed with each strip having the same thickness and width. The articulated mechanism 104 connecting the scraper blade 44 to the bulldozer 42 serves to maintain the lower edge 110 in a preselected position relative to the sloped surface 12. Preferably, the scraper blade 44 is positioned relative to the sloped surface 12 so that the bottom edge 110 is positioned parallel to the upper surface of the previously formed strip.

Figure 5:
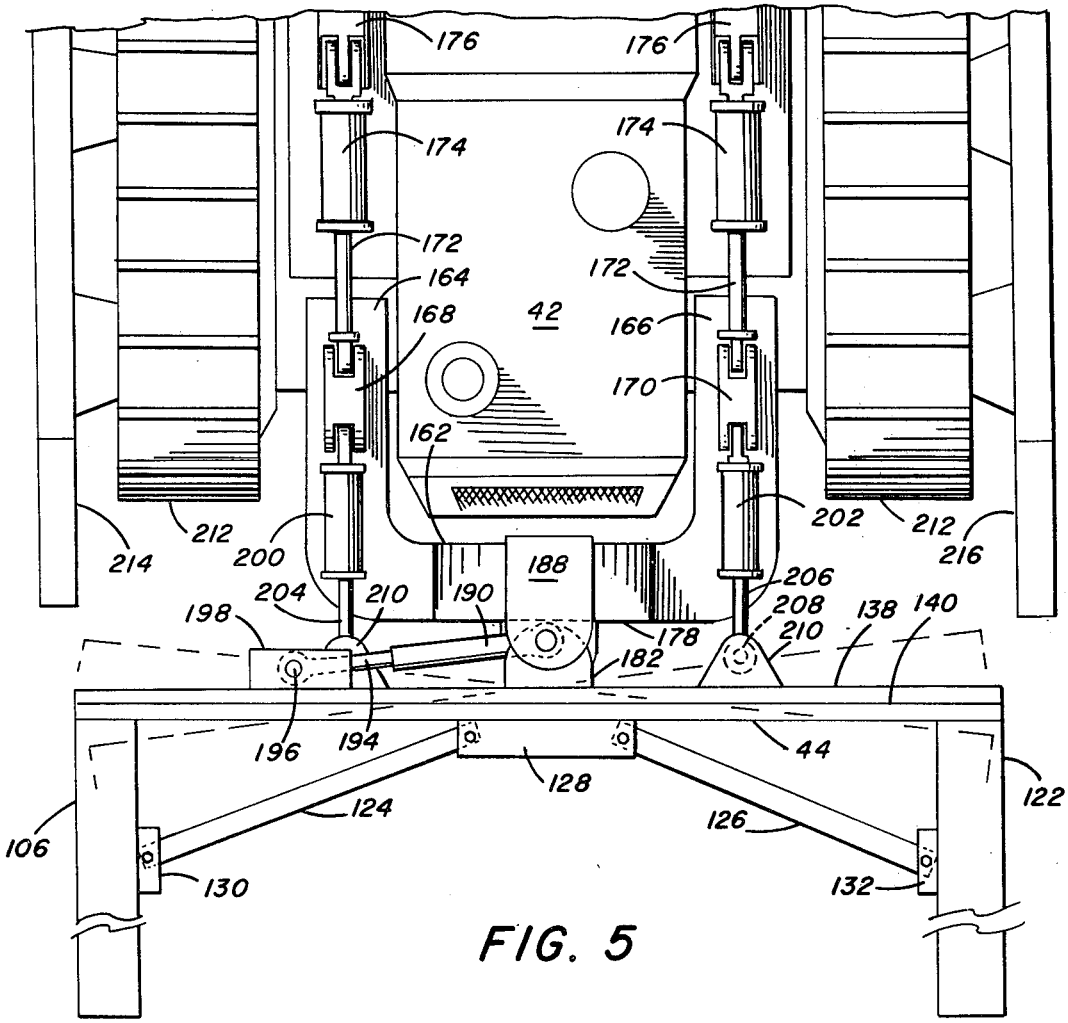
FIG. 5 is a top plan view of the spreader device, illustrating a scraper blade secured to the front of a bulldozer by an articulated connection for positioning the lower edge of the scraper blade relative to the sloped surface.

A second sidewall 122 of the spreader device 40 is connected to the opposite lateral edge of the scraper blade 44 positioned adjacent the sloped surface 12. The sidewall 122 extends forwardly of the blade 44 and is positioned parallel to the opposite sidewall 106. The connection of the sidewalls 106 and 122 to the scraper blade 44 is rigidified by brace members 124 and 126, as illustrated in FIG. 5. Each of the brace members is secured at one end portion to a bracket 128 that is welded to the vertical face of the scraper blade 44. The opposite ends of the braces 124 and 126 are connected to brackets 130 and 132 that extend outwardly from the sidewalls 106 and 122 respectively. With this arrangement the sidewalls 106 and 122 are rigidly connected to the scraper blade 44 and maintained in parallel relation to each other.

As illustrated in FIG. 2, the sidewall 122 has upper and lower edges 134 and 136 which define the length of the sidewall 122. This length is less than the length of the sidewall 106. The lower edge 136 is displaced from the upper surface of the previously formed strip 14 and extends slightly below the lower edge 110 of the scraper blade 44. With this arrangement the castable material is permitted to pass beneath the lower edge 136 as the blade 44 spreads the material upon the previously formed strip. As a result the castable material extends in a continuous strip from the sloped surface 12 outwardly to the sidewall 106.

The forwardly advancing scraper blade 44 moves through the pile 120 of the castable material and the material positioned above the lower edge 110 is pushed forwardly of the blade onto the previously formed strip. The material positioned below the lower edge 110 is shaped to the configuration of the lower edge 110 and the sidewall 106 to form a subsequent strip overlying the previously laid strip having a substantially horizontal upper surface as defined by the lower edge 110. At the opposite end of the scraper blade 44 adjacent the sloped surface 12 material passes beneath the lower edge 136 of sidewall 122 and converges onto the sloped surface 12.

As illustrated in FIG. 5, the sidewalls 106 and 122 together with the scraper blade 44 form a C-shaped arrangement that is secured to a mold board 138. The mold board is connected to the bulldozer 42 by the articulated mechanism 104. The mold board 38 extends vertically and includes a vertical face 140 that is positioned in substantially abutting relation with the rearward portion of the scraper blade 44. The scraper blade 44 is releasably connected to the forward face 140 of mold board 138 by nut and bolt combinations 142. This arrangement permits the scaper blade 44 to be removed from connection to the mold board 138 for reversing the position of the scraper blade sidewalls 106 and 122 when the longitudinal direction of travel of the bulldozer 42 is changed. This is necessary so that the sidewall 106 is always positioned adjacent the curved edge 54 of the previously formed strip.

When the bulldozer is advanced longitudinally relative to the sloped surface 12 as illustrated in FIG. 2, for example, in a north to south direction, the skid 118 of the sidewall 106 is slidable on the surface of the previously formed strip 14. Also, the lower edge 136 of sidewall 122 is positioned at the juncture of the sloped surface 12 and the strip being formed by the lower edge 110. Once bulldozer 42 has traversed the length of the sloped surface 12, the bulldozer 42 is rotated 180° for traversing the sloped surface 12 in the opposite direction. A change of direction of the dozer 42 from north-south to south-north requires changing the position of the scraper blade 44. The blade 44 is removed from connection to the mold board 138 by disassembling the nut and bolt combinations 142. The entire assembly of the sidewalls 106 and 122 and the scraper blade 44 is rotated to position the skid 116 on the surface of the previously formed strip and the upper edge 108 of the blade 44 becomes the bottom strip-forming edge. Also, in this reversed position, the edge 134 of sidewall 122 is positioned adjacent the juncture of the sloped surface 12 and the next strip to be formed.

Figure 7:
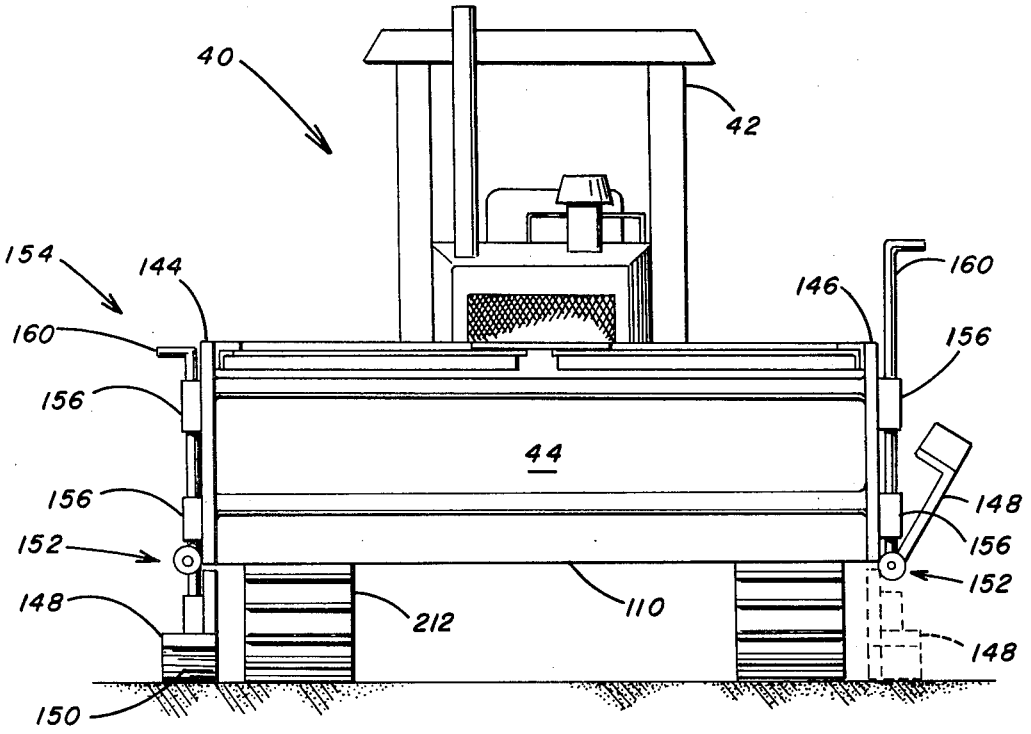
FIG. 7 is a front view of a second embodiment of the spreader device, illustrating a pair of forwardly extending sidewalls having pivotal depending portions for positioning a skid of one of the sidewalls in contact with a previously formed strip as determined by the direction of travel of the spreader device relative to the sloped surface.
Figure 8:
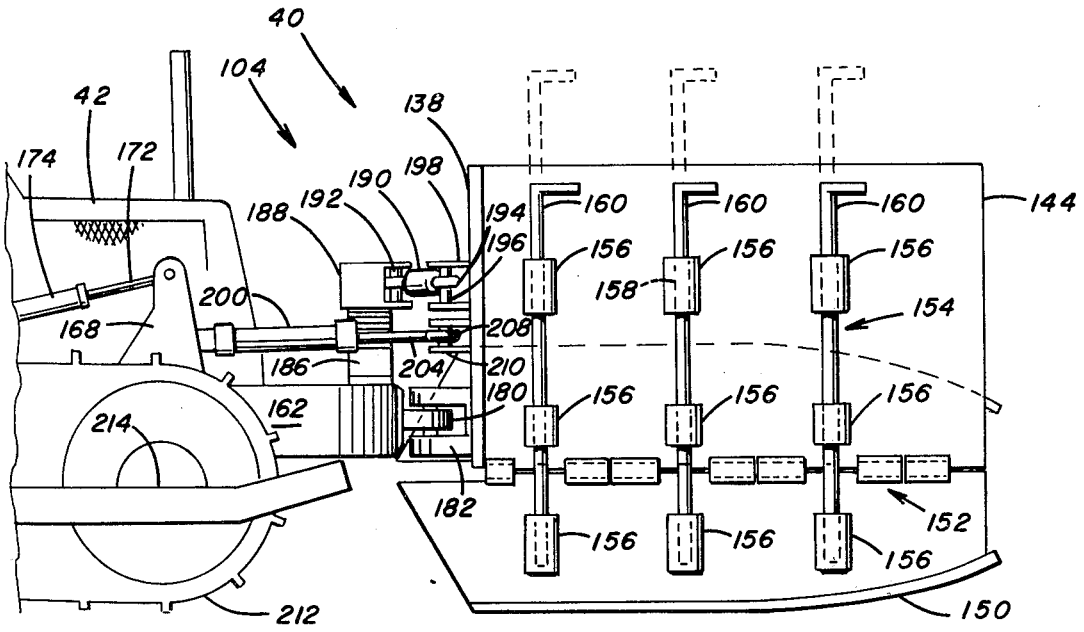
FIG. 8 is a view in side elevation of the embodiment of the spreader device illustrated in FIG. 7, showing a sidewall having a hinged depending portion with vertically movable pins for locking a skid in porition for slidable movement on a previously formed strip.

A change in direction of the bulldozer 42 on the sloped surface 12 may be accommodated without removing the scraper blade 44 from connection to the mold board 138 by the apparatus illustrated in FIGS. 7 and 8. In this embodiment of the spreader device 40, a pair of sidewalls 144 and 146 are secured to and extend forwardly of the scraper blade 44 as with the sidewalls 106 and 122 as illustrated in FIG. 5. The sidewalls 144 and 146 include a depending portion 148 that supports a skid 150 to slide on the previously formed strip. Th depending portion 148 is connected to the upper vertical portion of each of the sidewalls by a hinged connection generally designated by the numeral 152. This arrangement permits pivotal movement of the depending portion 148 about a horizontal axis for movement of the skid 150 into and out of contact with the surface of the previously formed strip.

Each depending portion 148 of the sidewalls 144 and 146 is operable to be retained in an operative position, depending on the distance of travel of the bulldozer 42 relative to the slope 12, by a locking mechanism generally designated by the numeral 154. The locking mechanism 154 includes a plurality of boss members 156 positioned in vertical rows on the upper portion of each sidewall and depending portion 148. Each of the bosses includes a vertical bore 158 with the bores in each vertical row aligned to receive an elongated pin 160. A pin 160 is provided for each vertical arrangement of bosses 156. With the skid 150 pivoted downwardly into an operative position, the pins 160 are inserted through the respective bosses and thereby retain the skid 150 in an operative position as illustrated in FIG. 8.

In order to pivot a selected one of the skids 150 upwardly from an operative position, as illustrated in phantom in FIG. 7 to a raised position, the pins 160 are raised upwardly. This position of the pins 160 is also illustrated in phantom in FIG. 8. The pins 160 are thus removed from the bores 158 within the bosses 156 on the depending portion 148 of the respective sidewall. The depending portion 148 can be retained in the raised position by any suitable means, such as by chains, straps, bars and the like connecting the raised depending portion 148 with the upper portion of the respective sidewall.

The depending portions 148 are retained in either an operative position with the accompanying skid 150 on the surface of the previously formed strip or in a raised position so that the accompanying skid 150 is removed from contact with the previously formed strip. The position of the respective depending portions 148 is determined by the longitudinal direction of travel of the bulldozer 42 relative to the sloped surface 12. In a first direction of travel of the bulldozer 42 on the sloped surface 12, for example north to south, the depending portion 148 associated with sidewall 144 is locked in an operative position by the pins 160. In this position the skid 150 slides on the previously formed strip. The depending portion 148 associated with the sidewall 146 is pivoted upwardly about the hinged connection 152 as illustrated in FIG. 7 by raising the pins 160 from the lowermost bosses 156. The lower end portion of the pins 160 are raised above the hinged connection 152. This frees the depending portion 148 on sidewall 146 for pivotal movement from the position illustrated in phantom to the raised position, where the skid 150 is removed from contact with the strip.

Upon completion of movement of the bulldozer 42 in a direction north to south on the sloped surface 12, the bulldozer 42 is turned around or rotated through an angle of 180°. With the bulldozer 42 in this position the sidewall 146 is positioned adjacent the exposed lateral edge 102 of a previously formed strip, and the sidewall 144 is positioned adjacent the sloped surface 12. Therefore, in order to form another strip on the previously formed strip, the depending portion 148 of sidewall 144 is freed for pivotal movement of the skid 150 from a position contacting the strip to a raised position adjacent the sidewall 144. The depending portion 148 associated with sidewall 146 is pivoted downwardly to position the skid 150 in contact with the strip. The pins 160 lock the skid of sidewall 146 in an operative position for slidable movemet on the strip. By making this adjustment the spreader device 40 is operable for moving longitudinally relative to the sloped surface 12 and laying a strip in a direction south to north on the previous strip.

Figure 6:
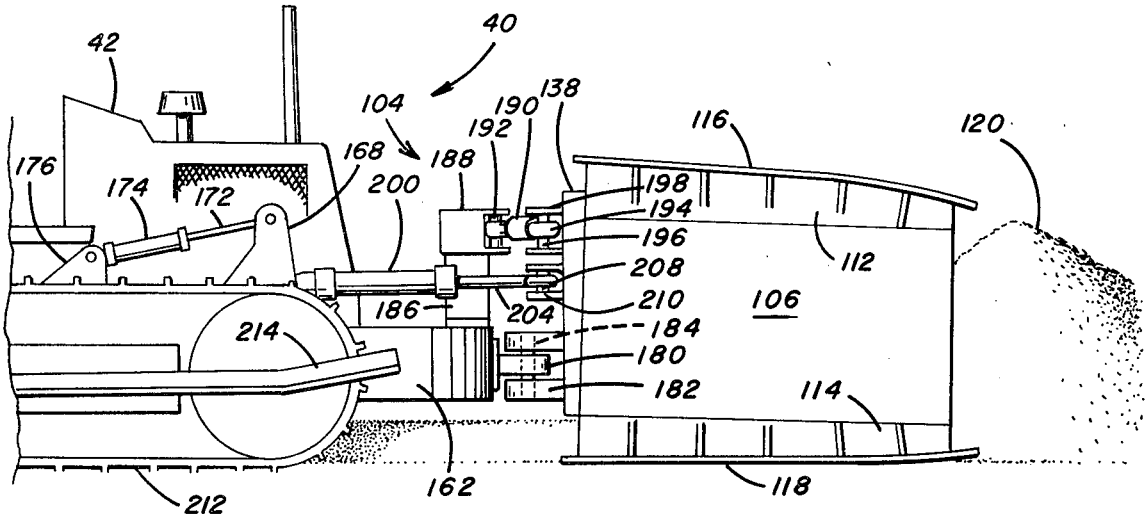
FIG. 6 is a fragmentary view in side elevation of the spreader device shown in FIG. 5, illustrating the forwardly extending sidewall supported for slidable movement on a previously formed strip.

As illustrated in FIGS. 5, 6 and 8 the spreader device 40 is connected to the bulldozer 42 by the articulated mechanism 104. The articulated mechanism 104 includes a yoke member 162 that has a pair of rearwardly extending arm members 164 and 166 that are pivotally connected in a conventional manner to the lower portions of a pair of lift booms 168 and 170. The opposite end of each of the lift booms 168 and 170 is connected to a piston rod 172 of a hydraulically operable piston cylinder assembly 174 that is pivotally connected to a link 176 secured to the frame of the bulldozer 42. With this arrangement actuation of the piston cylinder assemblies 174 to retract or extend the piston rods 172 pivots the lift booms 168 and 170 to raise or lower the yoke 162.

The yoke 162 has a front end portion 178 connecting the arm members 164 and 166. A tongue 180 projects forwardly from the front end portion 178 and is received within a clevis connection 182 that extends rearwardly of the mold board 138. The tongue 180 and clevis 182 include vertical bores that are aligned to receive a pin 184. With this arrangement the spreader device 40 is connected to the bulldozer 42.

A pedestal 186 is positioned on and extends upwardly from the yoke 162 and includes a bifurcated portion 188 at the upper end portion thereof. A piston cylinder assembly 190 is positioned within the clevis of the bifurcated portion 188 and is secured thereto by a vertical pivot pin 192. The piston cylinder assembly 190 includes a piston rod 194 connected at its opposite end by a vertical pivot pin 196 to a clevis connection 198. The clevis connection 198 extends rearwardly from the upper end portion of the mold board 138.

Actuation of the piston cylinder assembly 190 to extend or retract the piston rod 194 tilts the mold board 138 and the scraper blade 44 about the pivotal connection of the clevis 182 to the tongue 180. This provides relative adjustment of the lower edge 110 of the scraper blade 44 relative to the sloped surface 12 and accordingly the slope of the strip being formed. Preferably, the lower edge 110 is adjusted by the piston cylinder assembly 190 to form a strip 14 having an upper horizontal surface projecting outwardly from the sloped surface 12.

The mold board 138 and scraper blade 44 are also pivotal about the vertical axis of the pin 184 by a pair of piston cylinder assemblies 200 and 202. The assemblies 200 and 202 include piston rods 204 and 206 respectively with each of the rods connected at their end portion by a vertical pivot pin 208 retained in a clevis connection 210 on the rear of the mold board 138. The piston cylinder assemblies 200 and 202 are independently operable to pivot the scraper blade 44 about the vertical axis of the pin 184 connecting the clevis 182 to the tongue 180 of yoke 162. This permits adjustment to the angle at which the scraper blade 44 is pivoted about the vertical pivot pin 184.

As illustrated in phantom in FIG. 5, retraction of piston rod 204 and extension of piston rod 206 pivots the mold board 138 about the pin 184 to move the sidewall 106 rearwardly and the sidewall 122 forwardly. Accordingly, extension of piston rod 204 and retraction of piston rod 206 move the sidewall 106 forwardly and the sidewall 122 rearwardly. Thus, with the articulated mechanism 104 the entire spreader assembly 40 may be raised and lowered by the yoke 162 and the angular position of the lower edge 110 of the scraper blade 44 adjusted relative to the slope 12 by the piston cylinder assembly 190. Further, the position of the lateral edges of the scraper blade 44 and sidewalls 106 and 122 is adjustable by operation of the piston cylinder assemblies 200 and 202.

To assist in obtaining the desired overlapping relation between successive strips on the sloped surface a pair of outriggers 214 and 216 are supported laterally of bulldozer propelling tracks 212. The outriggers 214 and 216 serve as a guide in positioning the bulldozer 42 with respect to the sloped surface 12 for locating the sidewall positioned adjacent the exposed lateral edge 54 of the previously formed strip a preselected lateral distance from the edge 54. This adjustment provides the desired overlap of the strips to create a uniform step-like arrangement of the strips on the sloped surface 12.

As illustrated in FIGS. 1 and 2 the bulldozer 42 is positioned relative to the sloped surface 12 so that one of the outriggers 214 or 216 contacts the sloped surface 12. With the slope side outrigger, outrigger 216 in FIGS. 1 and 2, slidably positioned on the sloped surface 12, the sidewall 106 of the spreader device 40 is set at a preselected distance from the curved edge 54 of the previously formed strip. As the bulldozer 42 advances on the strip being formed, the outrigger 216 is maintained in contact with the sloped surface 12. In this manner a strip is formed having an exposed lateral edge that is substantially parallel to the lateral edge of the previously formed strip and spaced a preselected lateral distance therefrom.

As illustrated in FIG. 2, with the outrigger 216 slidably positioned on the sloped surface 12 the slope side track 212 is positioned on the slope and the bulldozer 42 is canted at an angle as it moves longitudinally relative to the slope. To compensate for the tilted position of the bulldozer 42 the piston cylinder assembly 190 is actuated to retract the piston rod 194 and thereby adjust the position of the lower edge 110 relative to the slope surface 12. The lower edge 110 is moved to a position parallel to the upper surface of the previously formed strip. Thus, by maintaining the slope side outrigger in contact with the sloped surface and adjusting the relative position of the lower edge 110 relative to the sloped surface 12, a strip having a preselected thickness is formed on the previously formed strip. Thus, a plurality of strips can be formed in overlapping arrangement so that the sloped surface 12 is paved in a step-like configuration as illustrated in FIG. 1.

Once the strip is formed by the spreader device 40, the rollers 48 and 50 following in tandem relation behind the bulldozer 42 on the formed strip compact the strip to a preselected degree of compaction. The first roller 48 is pushed behind the bulldozer 42 by a prime mover such as the tractor 56 so that the roller 48 is positioned between the tractor 46 and the bulldozer 42. The tractor 56 is followed by a second tractor 58 which pulls the second roller 50 to complete the compacting operation. With the bulldozer 42 advancing relative to the slope 12 in the direction indicated in FIG. 3, the tractor 56 follows the bulldozer 42 and precedes the tractor 58. However, when the bulldozer advances in the opposite direction, the tractor 56 follows the tractor 58. Thus, for both directions of operation, the roller positioned behind the bulldozer 42 is pushed and is thereby followed by a second roller, which is pulled. This arrangement provides an optimum degree of compaction of the formed strip.

Each of the tractors 56 and 58 includes a forwardly extending roller support frame 218 that is connected to the frame of the respective tractor by a vertical hinge pin (not shown). The roller support frame 218 has a rectangular configuration formed by a pair of brace members 220 and 222 that are maintained in spaced relationship and connected to a second pair of spaced brace members 224 and 226. Each of the rollers is rotatably supported by the rectangular frame. The front and rear brace members 224 and 226 include wiper blades 228 that contact the surface of the roller and remove castable material that sticks to the roller. Each of the rollers 48 and 50 have a cylindrical configuration with outer and inner curved surfaces 230 and 232.

A vibrating device generally designated by the numeral 234 is supported by the side brace members 220 and 222 within the interior of each of the rollers. The vibrating device 234 includes a cylindrical member 236 that is rotatably supported on a shaft (not shown) mounted on the side braces 220 and 222. The cylindrical member 236 is eccentrically positioned within the interior of the roller. The cylindrical member 236 has a diameter which is less than the interior diameter of the roller and is so supported on the brace members that the outer cylindrical surface of member 236 abuts the inner surface 232 of the roller.

A suitable drive means such as a hydraulic motor (not shown) is drivingly connected to the shaft upon which the cylindrical member 236 is mounted. The motor is operable to rotate the cylindrical member and apply a vibrating force to the roller as the roller is propelled by the tractor. Thus, with this arrangement the strip is first compacted by the rollers and further compacted by the vibrating force applied thereto by the eccentrically positioned cylindrical member 236.

The roller 50 is pulled behind the tractor 58 as the bulldozer 42 advances in the direction indicated in FIG. 3. As illustrated in FIG. 4, the end of the roller 50, as well as the end of the roller 48, is provided with a forming portion 238. The forming portion 238 includes a flange having an outer lip 240 and a curved portion 242 that converges from the cylindrical surface 230 of the roller to the end of the lip 240. In this manner a frustoconical portion is formed on the end of each roller having the configuration of a frustum of a cone. The frustoconical portion of each roller is arranged to engage the lateral edge 102 of each strip formed by the scraper blade 44 and outer sidewall. The frustoconical portion compresses the edge and forms the rounded edge 54. The shape of the rounded edge 54 conforms to the curved portion 242. Also, the lip 240 extends the thickness of the strip and contacts the upper surface of the previous strip to laterally compress the rounded edge 54. Forward movement of each roller advances the curved portion 242 on the lateral edge 102 and the lateral edge is shaped to conform to the configuration of the curved portion 242. Simultaneously, with the forming of the rounded edge 54 the vibrating device 234 also imparts a vibrating force to the forming portion 238. This also serves to compact the curved edge 54 in addition to the movement of the curved portion 242 over the edge 54.

A guide mechanism 244 extends forwardly from the side of roller support frame 218 adjacent the curved portion 242 of each of the rollers 48 and 50. The guide mechanism 244 is operable to enable the tractor operator to maintain the curved portion 242 in contact with the lateral edge 102 of the strip being compacted. The guide mechanism 244 includes a forwardly extending bar having a downwardly extending portion 246. The tractor operator, by aligning the downwardly projecting portion 246 with the lateral edge 102, maintains the curved portion 242 of the roller in contact with the lateral edge 102 of the strip to ensure formation of the curved edge 54. Thus, it will be apparent from the present invention that the rollers 48 and 50 in combination with the spreader device 40 form a strip having a degree of compaction capable of resisting erosion and thereby operable to efficiently break up the wave action in a body of water bounded by sloped walls paved by an overlapping arrangement of step-like breakers 14.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for compacting a strip of castable material comprising, roller means for compacting the strip to a preselected degree of compaction, propelling means for advancing said roller means longitudinally on the strip, said roller means having a cylindrical body portion with one end portion having the configuration of a frustum of a cone, and forming means associated with said one end portion of said roller means body portion for engaging a longitudinal edge of the strip to shape the edge of the strip to form a curved edge thereon.

2. Apparatus for compacting a strip of castable material as set forth in claim 1 in which said roller means includes, a roller, said roller having a preselected lateral dimension, said forming means connected to one end of said roller, said forming means having a frustoconical end portion with the configuration of a frustum of a cone, and said frustoconical end portion having a lip portion, said lip portion being arranged to extend opposite the longitudinal edge of the strip and downwardly the depth of the strip to round the edge of the strip with a preselected degree of compaction.

3. Apparatus for compacting a strip of castable material as set forth in claim 1 in which said roller means includes, a first roller, a second roller positioned in spaced tandem relation to said first roller on the strip, each of said first and second rollers having a cylindrical body portion with one end portion having the configuration of a frustum of a cone operable to round the longitudinal edge of the strip to form a curved edge thereon, and said propelling means being positioned between said first and second rollers such that said first roller is pushed by said propelling means and said second roller is pulled by said propelling means.

4. Apparatus for comprising a strip of castable material as set forth in claim 3 which includes, said end portion of each of said first and second rollers having a lip portion extending opposite the longitudinal edge of the strip and downwardly the depth of the strip to engage the edge of the strip and round the edge of the strip with a preselected degree of compaction.

5. Apparatus for compacting a strip of castable material as set forth in claim 1 which includes, vibrating means associated with said roller means for imparting an oscillating force to said roller means cylindrical body portion and thereby compact the upper surface of the strip and said curved edge formed thereon to a preselected degree of compaction.

* * * * *